US006755678B2

(12) United States Patent
Ward et al.

(10) Patent No.: US 6,755,678 B2
(45) Date of Patent: Jun. 29, 2004

(54) WIRE RETAINING CONNECTOR BLOCK

(75) Inventors: Bobby Gene Ward, King, NC (US); David Charles Strausser, Winston-Salem, NC (US)

(73) Assignee: Tyco Electronics Corporation, Middletown, PA (US)

( * ) Notice: Subject to any disclaimer, the term of this patent is extended or adjusted under 35 U.S.C. 154(b) by 2 days.

(21) Appl. No.: 10/128,747

(22) Filed: Apr. 22, 2002

(65) Prior Publication Data

US 2003/0199191 A1 Oct. 23, 2003

(51) Int. Cl.[7] ..... H01R 11/20
(52) U.S. Cl. ..... 439/402; 439/404
(58) Field of Search ..... 439/402, 404, 439/400, 417, 418

(56) References Cited

U.S. PATENT DOCUMENTS

| | | | | |
|---|---|---|---|---|
| 3,012,219 | A | | 12/1961 | Levin |
| 3,718,888 | A | | 2/1973 | Pasternak |
| 3,953,925 | A | | 5/1976 | Wilson |
| 4,178,055 | A | | 12/1979 | Fleischhacker et al. |
| 4,195,158 | A | | 3/1980 | Weidler |
| 4,227,763 | A | | 10/1980 | Marks |
| 4,653,831 | A | | 3/1987 | Wilson et al. |
| 4,797,112 | A | | 1/1989 | Weisenburger |
| 4,964,811 | A | | 10/1990 | Hayes, Sr. et al. |
| 5,073,126 | A | | 12/1991 | Kikuchi et al. |
| 5,270,558 | A | | 12/1993 | Scherer et al. |
| 5,484,186 | A | | 1/1996 | Van Order et al. |
| 5,547,391 | A | | 8/1996 | Benes et al. |
| 5,577,930 | A | | 11/1996 | Dahlem et al. |
| 5,622,515 | A | | 4/1997 | Hotea et al. |
| 5,709,566 | A | * | 1/1998 | Tsuji et al. ..... 439/397 |
| 5,825,096 | A | | 10/1998 | Morimoto et al. |
| 5,887,939 | A | | 3/1999 | Yamaguchi et al. |
| 6,120,091 | A | | 9/2000 | Reich et al. |
| 6,199,948 | B1 | | 3/2001 | Bush et al. |
| 6,204,209 | B1 | | 3/2001 | Rozek et al. |

* cited by examiner

*Primary Examiner*—P. Austin Bradley
*Assistant Examiner*—Briggitte R. Hammond

(57) ABSTRACT

A commoning electrical connector 2 includes multiple insulation displacement terminals 30 mounted in a molded electrical connector housing 10. The connector 2 can be used to common wires 4 in automotive wiring harnesses and provides a low profile package for mounting wires in a confined space, such as in an automobile headliner. The terminated connector 2 can be adhesively bonded to a substructure, such as an automobile headliner. The molded housing 10 also includes wire retention members 14 on exterior faces of side walls so that the housing 10 can be molded without side pulls. Wires are laced in a termination fixture 60, and the connector 2 aligned by fixture posts 70 and alignment holes 22 on the connector, which is then pushed onto the termination fixture 60 to terminate wires 4 in insulation displacement slots 32.

13 Claims, 6 Drawing Sheets

FIG 3
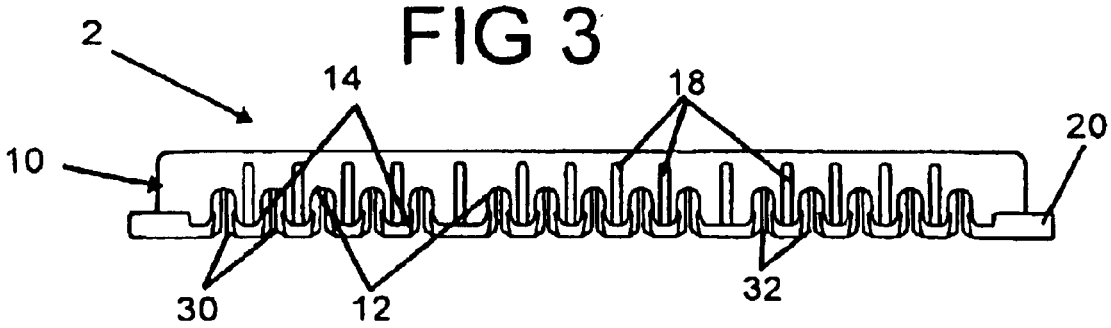
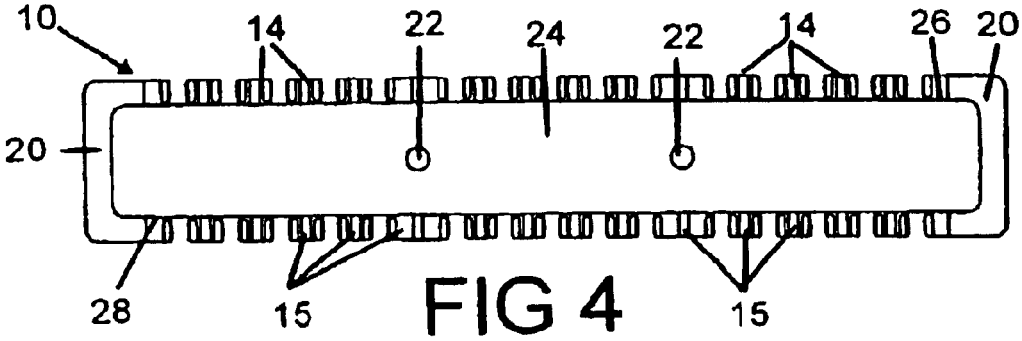
FIG 4
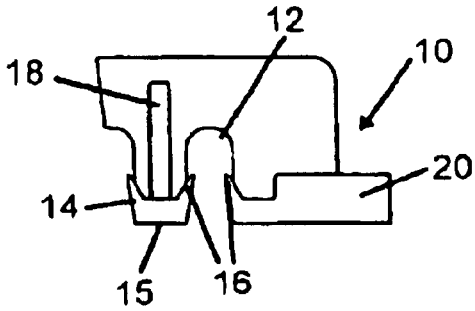
FIG 5

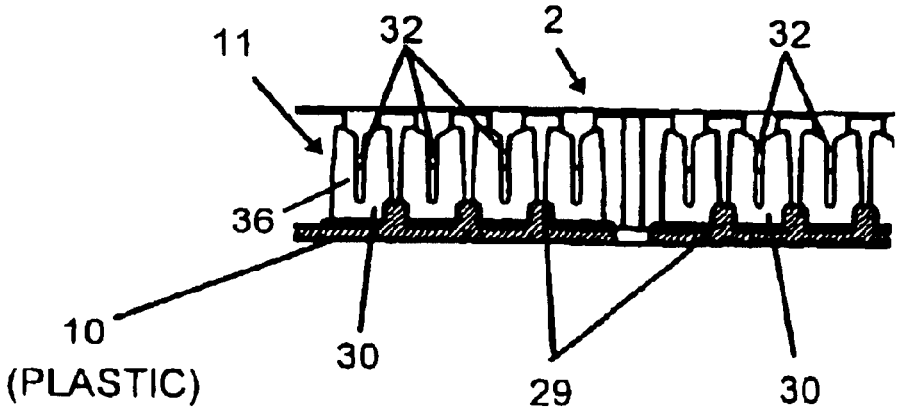
FIG 6
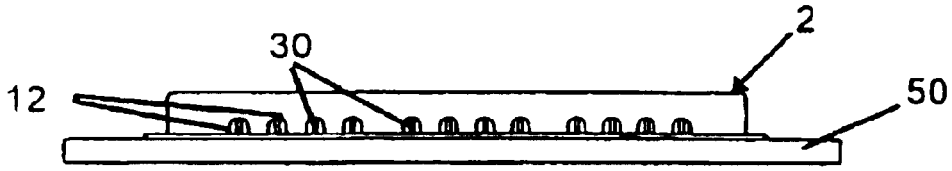
FIG 8
FIG 13
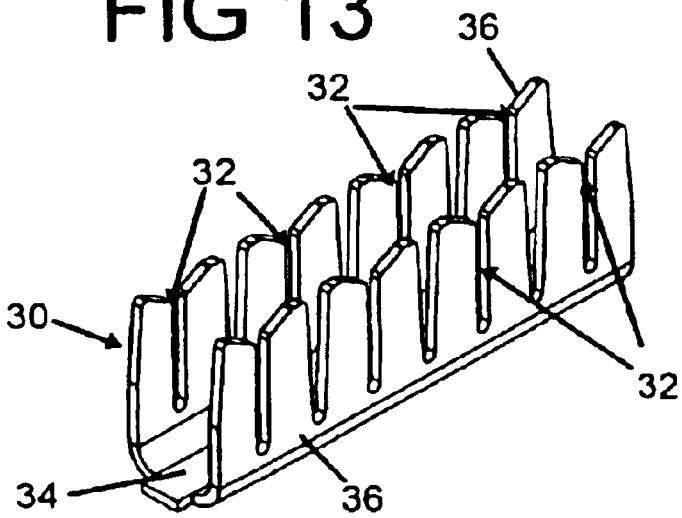

WIRE RETAINING CONNECTOR BLOCK

BACKGROUND OF THE INVENTION

1. Field of the Invention

This invention relates to a connecting block or wire retaining block for mechanically securing wires to a substructure and for interconnecting corresponding wires. This invention is also related to the installation of electrical wiring systems in motor vehicles, for the example the installation of wiring harnesses in the headliner of an automobile.

2. Description of the Prior Art

Installation of wire harness in motor vehicles is often complicated by the need to place the wire harnesses within a confined space. One example is the installation of wire harnesses along the roof or ceiling of an automobile.

U.S. Pat. No. 5,547,391 discloses an electrical connector in which wires can be terminated to insulation displacement terminal having multiple wire receiving slots. One use of an electrical connector of this type is to mount wires in wiring harnesses in the headliner of an automobile. Individual wires are laced into a first temporary wire retaining section of the electrical connector. After a number of wires are laced into position in first temporary wire restraining sections aligned with corresponding wire receiving slots, all of the wires may be subsequently mass terminated to connector terminals with multiple wire receiving slots. Once the wires, and wiring harnesses, are terminated to the connector, the connector can then be mounted on a substructure, such as an automobile headliner. Snap latches on a connector of this type can be snapped into engagement with locking means on the substructure or headliner to mount the terminated connector.

There are several practical problems to the use of a prior art electrical connector of this type to mount a plurality of wires, often in cumbersome wiring harnesses, on a substructure, such as an automobile headliner. Lacing the wires into the connector prior to mass termination means that the connector, with multiple wiring harnesses attached, must be mounted into a mass termination tool. The terminated connector must then be removed from the termination fixture and then mounted to the headliner, which means that the connector must be manipulated into position with wires and wiring harnesses draped from the terminated connector. If the connector is snapped to the substructure, the connector will protrude from the substructure. Inclusion of snap locks into the substructure will also add height to the substructure, and the resultant assembly will be relatively thick, especially in the vicinity of the terminated electrical connector. It will then be difficult to position the relatively bulky structure in a confined space, and structures such as automobile headliners should preferably be as thin as possible to fit within as small a space as possible. Practical implementation of an assembly of this type also requires the use of a separate spring retainer clip, and the assembly must be mounted in a separate pan that is in turn mounted in the headliner.

Another approach to assembling a wiring harness in the ceiling of an automobile is discussed in U.S. Pat. No. 5,887,939. In that approach harness connectors and harness clips, referred to as cramps, are snapped into holes in a roof module prior to assembly of the roof module into the automobile ceiling. Bonding tape is also used to secure the harness to the ceiling. The use of doubled sided adhesive tape to secure a wiring harness in a roof module or ceiling is also discussed in U.S. Pat. No. 5,852,096. Typically bonding tape is used as part of an on-line assembly of the wires or wiring harnesses in an automobile. However, offline assembly of the wiring harness to the headliner or similar substructure would be preferable.

SUMMARY OF THE INVENTION

An electrical connector according to this invention is used to common wires and to mount the wires on a substructure, such as an automotive headliner. The electrical connector includes a molded housing with a cavity formed by side walls with channels extending through the side wall. One or more insulation displacement terminals are mounted in the cavity and secured to the molded housing. Each insulation displacement terminal includes multiple wire receiving slots aligned with the channels extending though the walls. Each insulation displacement terminal commons multiple wires received within its wire receiving slots. Wire retention members are molded as part of the housing on an exterior surface of the side walls. Each wire retention member is positioned to prevent extraction of a wire from the wire receiving slot and from the channel after the wire has been terminated to the insulation displacement terminal.

Such a connector can be used as part of an assembly to mount wires in a plurality of wire harnesses to the surface of a substructure, such as an automobile headliner. As used in this manner, the electrical connector can include a plurality of insulation displacement terminals mounted end to end within the cavity in the molded housing. Each insulation displacement terminal includes a plurality of wire receiving slots exposed on an open face of the molded housing bounded in part by side walls of the cavity. A connector-receiving trough is located on a surface of the substructure to which the wire harnesses are to be mounted. The connector receiving trough is dimensioned to receive the molded housing and forms a reservoir for containing an adhesive, such as a holt melt adhesive, to secure the electrical connector to the substructure.

A method of mounting wiring harnesses on a substructure and of commoning wires in separate wiring harness includes several steps. Individual wires in multiple wiring harnesses are mounted in a termination fixture with a series of grooves in which the individual wires are mounted. The electrical connector, with multiple insulation displacement terminals, is mounted with terminal slots in alignment with a respective one of the grooves on the termination fixture. Wires in aligned wire receiving slots are terminated by compressing the termination fixture relative to the electrical connector. Adhesive is applied between the electrical connector, with wires terminated therein, and the substructure to adhesively secure the electrical connector to the substructure and to mount the electrical connector to the substructure, such as an automobile headliner.

BRIEF DESCRIPTION OF THE DRAWINGS

FIG. 3 is a side view of the electrical connector showing the alignment of terminal slots with wire receiving channels flanked by wire retaining members.

FIG. 4 is a top view of the electrical connector shown in FIGS. 1–3.

FIG. 5 is a partial side view of one end of the electrical connector shown in FIGS. 1–4.

FIG. 6 is a partial section view showing two multiple connector terminals mounted in cavity 11.

FIG. 8 is a side view showing the extent to which the electrical connector protrudes above the substructure. Terminated wires in the connector have been omitted for clarity.

FIG. 13 is an enlarged three dimensional view of one of the insulation displacement terminals used in the embodiments of this invention.

DESCRIPTION OF THE PREFERRED EMBODIMENTS

Figure 1:
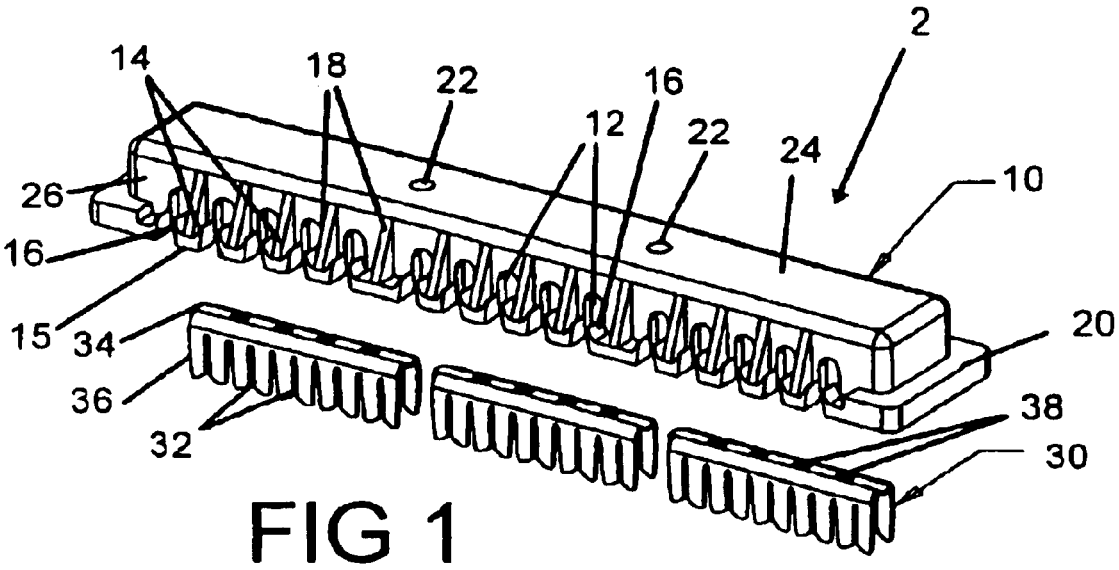
FIG. 1 is an exploded three-dimensional view of an electrical connector. Multicontact terminals are shown exploded from the molded housing in which they are mounted.
Figure 2:
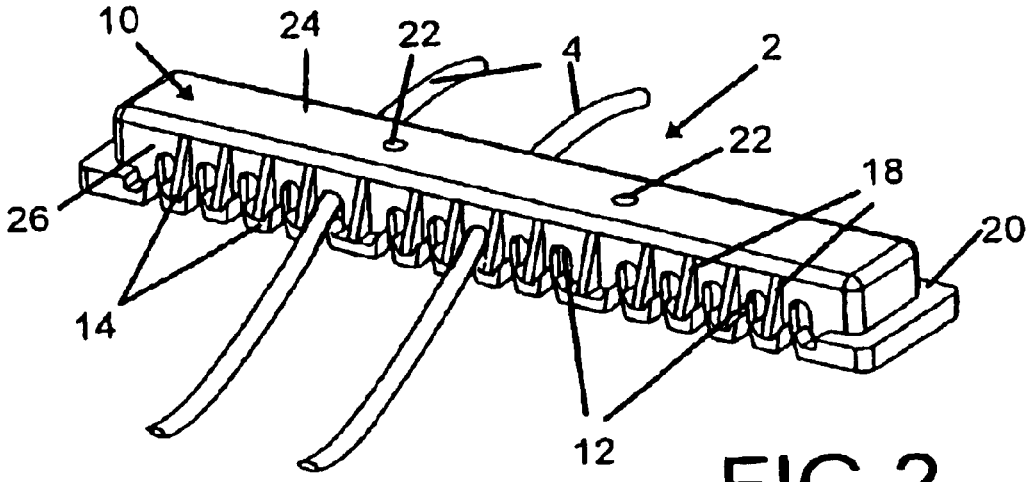
FIG. 2 is a three dimensional view of the electrical connector of FIG. 1, showing two wires assembled in the electrical connector.

The electrical connector or wire commoning block 2, comprising the preferred embodiment of this invention, is intended to provide a compact device in which a number of wires 4 can be terminated and commoned to other corresponding wires. One example configuration, a fifteen position connector, has a length of approximately 66–70 mm., a height of approximately 6–7 mm. and a width of approximately 14 mm. Wires 4 can also be easily mass terminated to the insulation displacement terminals 30 without excessive manipulation of the wire harnesses and the individual wires. The terminated connector 2 and the wires 4 can also be easily mounted on a substructure 50, such as an automotive headliner.

The electrical connector 2 includes a molded housing 10 with at least one multi-contact terminal 30 mounted in a housing cavity 11. Normally each connector 2 will have two or more separate terminals 30 mounted end to end in the housing cavity 11. Wire receiving slots 32 are aligned with channels 12 in opposite side walls 26, 28 in the molded housing.

The molded housing 10 comprises a one piece member that is molded from a conventional thermoplastic material, although other materials, such as a thermoset plastic could also be employed. The housing 10 can also be molded using simple straight action mold tooling and nor side pulls or undercuts are required. The housing cavity 11 extends between opposite ends of the housing 10 and has one open face. Opposed housing side walls 26 and 28 and a base wall 24 surround the cavity 11 on three sides. Opposite ends of the cavity 11 are closed.

Aligned channels 12 extend through the opposite side walls 26 and 28. In the representative embodiment shown in FIGS. 1–4, fifteen channels 12 are divided into three groups of five. The five channels 12, in each of the three groups are evenly spaced on centerlines of approximately 3.75 mm. in this example. Interior channels in each group are separated from a channel in the next group by a slightly greater distance to provide space for termination alignment means, which will be subsequently discussed in greater detail. Wire retention members 14 are located on opposite sides of each of the channel. Each wire retention member 14, between a pair of channels 12, includes a pair of tangs 16 extending from an intervening flat surface 15 facing toward the open face of the connector 2. These wire retention members 14 have inclined surfaces to permit insertion of a wire 4, but the tangs 16 grip the fully inserted wire to prevent extraction of the wire 4. A central rib 18 extends upwardly from the distal end of each wire retention member to strengthen the wire retention member 14 and wire retention tangs or tines 16 and to isolate wires 4 in adjacent channels 12. In the preferred embodiment, each entire wire retention member 14 extends outwardly from the exterior face of the wall 26 or 28 on which the retention member 14 is located. Wire retention members 14, exposed in this manner, can be molded by opposed faces of opposed straight action mold halves, and no undercutting or side pulls are necessary to form the wire retention members 14.

The molded housing 10 also includes end flange ledges 20 protruding form opposite ends of the main housing body. These ledges 20 have flat surfaces along the open end of the housing 10. These flat surfaces on the end ledges 20 are in substantially the same plane as the flat surfaces 15 on the distal ends of the wire retention members 14. Together these flat surfaces form a segmented ledge that surrounds the open face of the housing cavity 11. This segment ledge provides additional surface area along which the electrical connector 2 can be adhesively bonded to the substructure, as will be subsequently discussed in more detail.

Separate multi-contact terminals 30, each having multiple wire receiving slots 32 are mounted in the housing cavity 11 by mounting tabs 29 that extend through mounting openings 38 that extend though the terminal base 34. Each terminal 30 is a U-shaped member having two terminal walls 36 extending upwardly from the terminal base 34. The terminal walls 36 are formed by coplanar tines that extend upwards from the terminal base 34, with wire receiving slots 32 thus being formed between adjacent tines. These slotted terminals form a gas tight connection with the conductive core of each wire 4 inserted laterally of its axis into a wire receiving slot 32. The terminals 30 can be secured to the mounting tabs or posts 29 by deforming the plastic posts extending through the openings 38. The posts can be deformed by heat staking, by ultrasonic means, or they can be deformed by a simple mechanical impact.

Each terminal 30 commons multiple wires that are terminated in wire receiving slots 32 in the same terminal. A terminal having five wire receiving slots 32 could common at least five wires having the same function. For instance, ground wires in five separate wiring harnesses could be commoned in an insulation displacement terminal 30 having five wire receiving slots. A commoning electrical connector having three separate terminals could common groups of wires having three different functions. In the preferred embodiments, the wire receiving slots 32 are positioned on the same wire to wire centerlines, even in separate terminals 30, when each of the wires to be terminated are the same gauge. Thus the terminals 30 can all be fabricated from a continuous strip of stamped and formed terminals by separating the continuous strip into individual terminals having three, four, five or any desired number of wire receiving slots in a given terminal. As previously mentioned, the separate groups of wire channel 12 are separated by a space sufficient to receive an alignment pin. Therefore the separation between an end slot in one terminal will be greater than the slot to slot separation within the same terminal, at least for the representative embodiments depicted herein.

Figure 7:
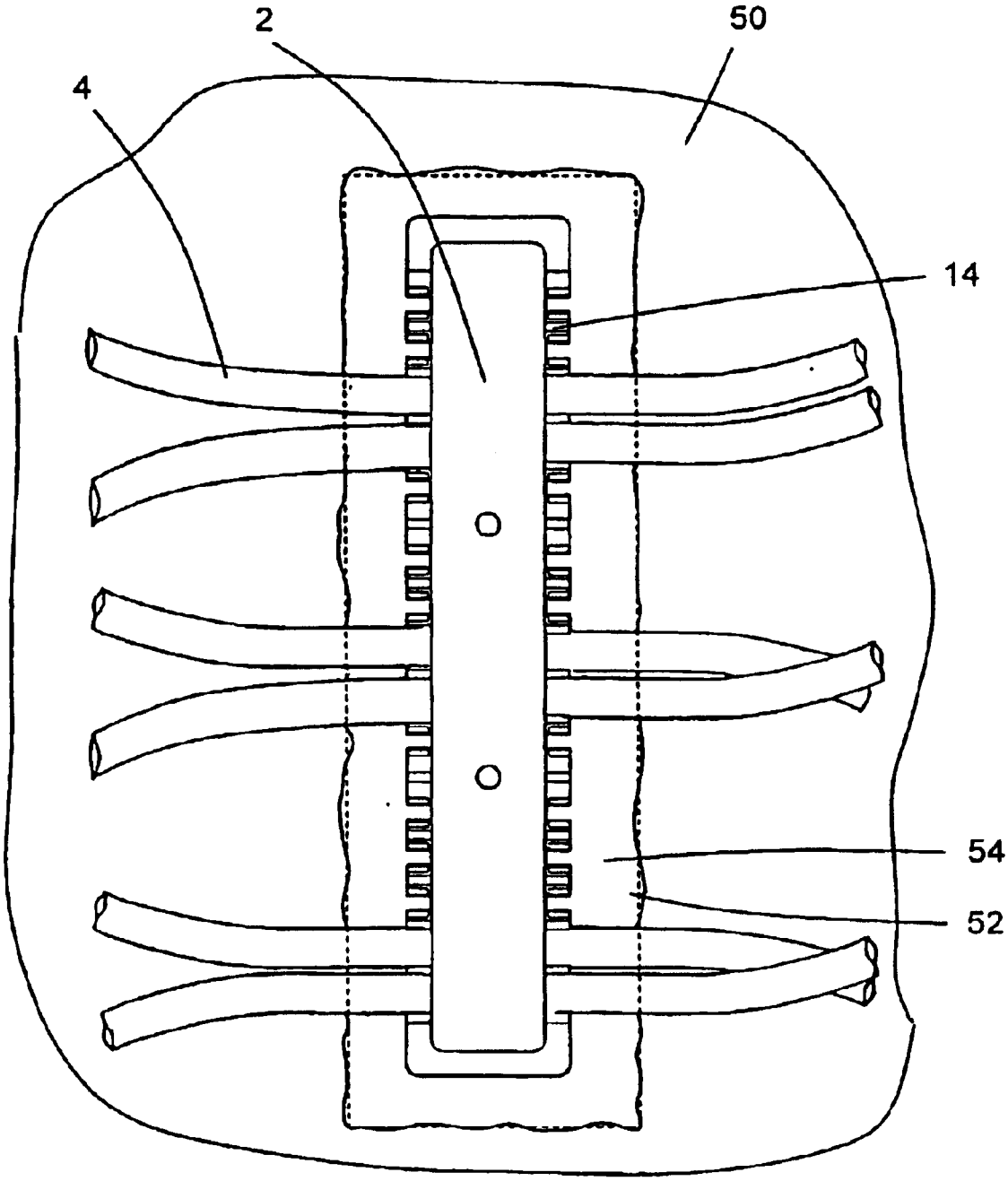
FIG. 7 is a top view of the electrical connector mounted to a substructure.

In addition to comprising means for commoning multiple wires or multiple wires in different wire harnesses, the electrical connector 2 also comprises means for mounting the wires or wire harnessed to a substructure 50, such as an automobile headliner. FIGS. 7 and 8 illustrate the low profile of this wire mounting means. After the wires 4 are terminated within wire receiving slots 32 in a prescribed configuration, the commoning connector 2 is adhesively bonded to a substructure 50, a portion of which is depicted in FIGS. 7 and 8.

In the preferred embodiment, the substructure 50 includes a trench 52 or a recessed area that serves as a reservoir for an adhesive or bonding agent, such as a conventional hot melt adhesive. To mount the connector 2 with wires 4 commoned therein, the connector 2 is pressed into the adhesive mass 54 contained within the trench 52. The open face of the cavity 11 and the top of the wire retention members 14 are pressed into the adhesive material leaving the housing base wall 24 exposed, as shown in FIG. 8. The hot melt adhesive 54, or other bonding agent can flow into the housing cavity 11 and around the outside of the connector 2 and the wires 4. The hot melt adhesive 54 will then secure the electrical connector 2 and the wires 4 to the substructure 50 and will further isolate the connection between the wires 4 and the terminals 30 in the wire receiving slots 32 making this connection even more gas tight. The adhesive will also reduce vibration and noise and provide additional insulation surrounding the wires and terminals.

Since the trench 52 is recessed into the substructure 50, the height of the mounted electrical connector 2 and wires 4 will be significantly less than the height of the connector 2. This assembly is therefore easily adapted for use in a confined space where the total height of the assembly will be a critical consideration. An automobile headliner assembly is one of those instances in which space, and the height of any protrusions is important. This commoning block or connector 2 could also be used in other areas such as in motor vehicle doors or on the rear deck of an automobile.

Although the commoning block will normally be positioned within a recess or trough, to reduce the overall height of the assembly, the commoning block can also be attached on the contour of the headliner or substructure where there is adequate space. The commoning block 2 can thus be located where access to the wires to be commoned is most convenient. Since the commoning block 2 is adhesively bonded, it is not necessary to snap or secure the block 2 to a pan or other structure that must be fabricated from a relatively high density plastic. The commoning block 2 can be mounted on a structure fabricated from a foam or low density plastic further reducing the cost of the completed assembly.

Figure 9:
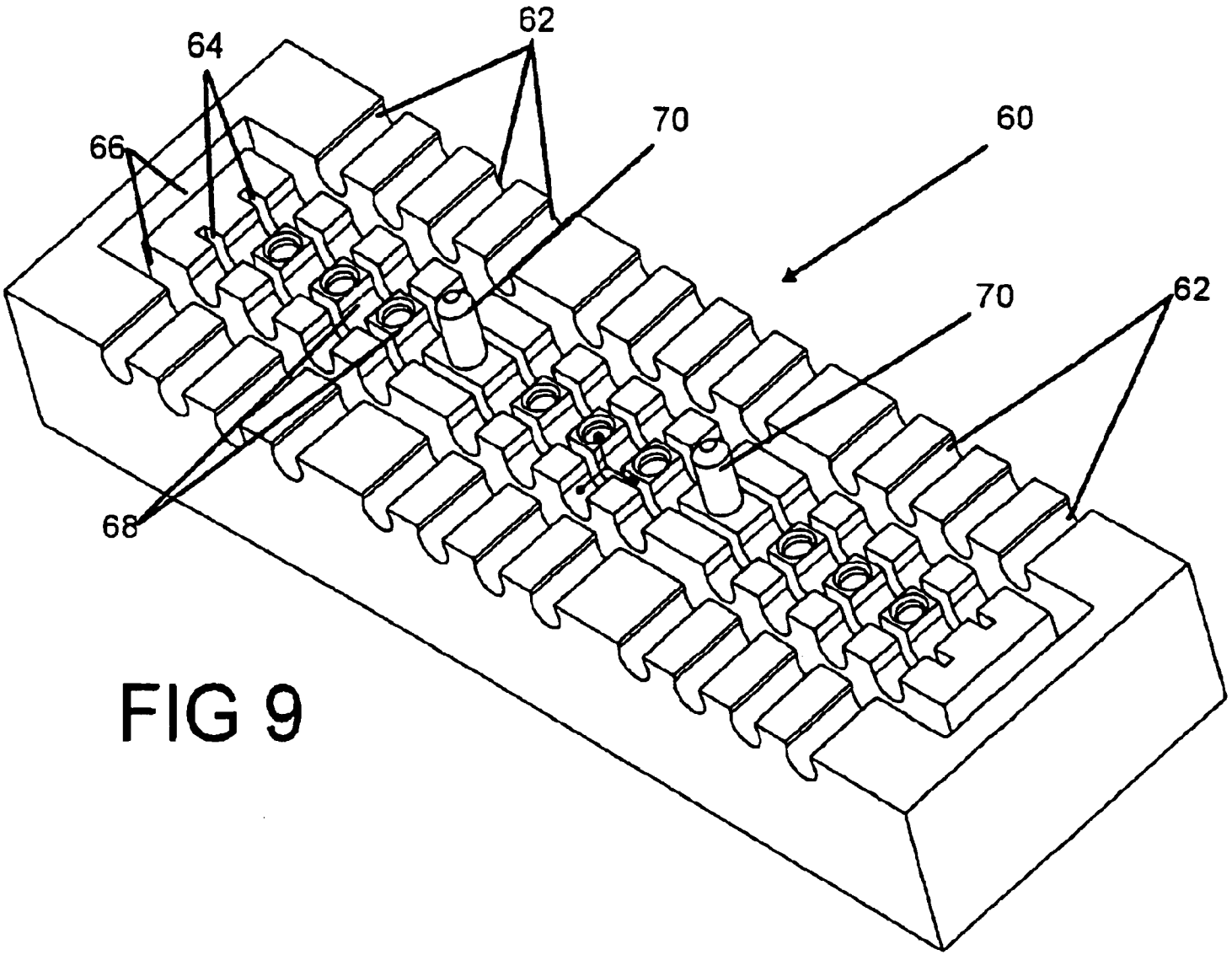
FIG. 9 is a three dimensional view of a mass termination tool employed to mass terminate wires to the insulation displacement electrical connector shown in FIGS. 1–8.
Figure 10:
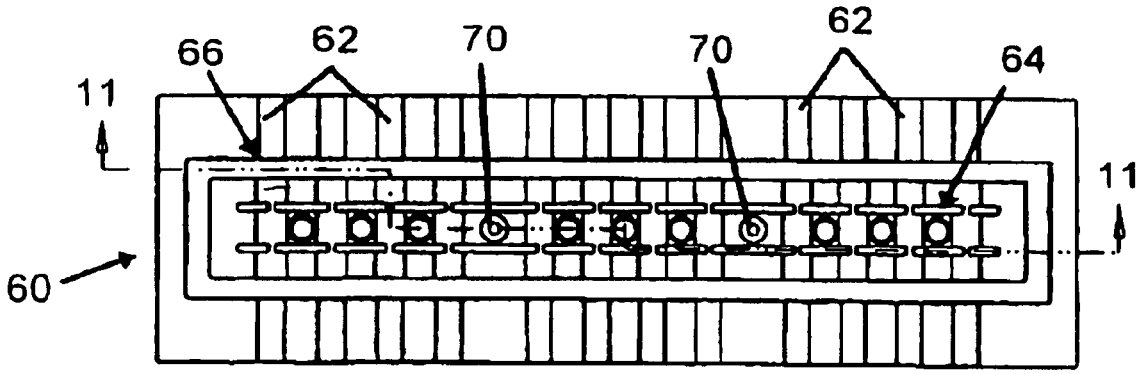
FIG. 10 is a top view of the mass termination tool shown in FIG. 9.
Figure 11:
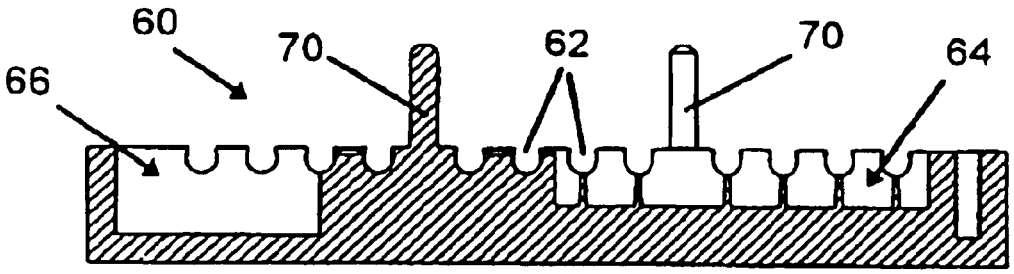
FIG. 11 is a section view taken along the section lines 11—11 in FIG. 10.

Not only should the completed assembly have a low installed profile, but termination of the wires 4 to the electrical connector 2 should also be as simple as possible. This connector 2 can be used with a mass termination tool 60, shown in FIGS. 9–11 to simplify termination of wires 4 to the terminals 30. The template 60 includes wire receiving grooves 62 located on the same spacing as the corresponding wire receiving slots 32 and the channels 12. Individual wires are laced into appropriate grooves 62 to position the wires 4 for mass termination in the electrical connector 2. The wires are individually laced into grooves 62, and if multiple wire harnesses are to be terminated, wires in separate wire harness can be separated and laced into appropriate grooves in the termination tool or fixture. Individual wire harnesses can then be handled one at a time, prior to the insertion of wires into the electrical connector 2. Use of a termination fixture to allow separate handling of the wire harnesses simplifies the installation procedure.

After all wires 4 are positioned within grooves 62 in termination fixture 60, an electrical connector 2 can be mounted on the termination fixture 60, above the wires 4. The termination fixture includes grooves 64 that provide clearance for the two terminal walls 36. Outer grooves 66 are dimensioned to permit insertion of the four walls of the molded housing 10, that surround the cavity 11. The outer grooves 66 are also wide enough to receive the wire retention members 14. Ribs 68 between the terminal grooves 64 provide space for ejectors to remove the terminated connector or commoning block 2 from the termination fixture 60.

The termination fixture 60 also includes two alignment pins 70 that protrude above the top surface of the termination fixture. These alignment posts 70 will fit through the two alignment holes 22 on the base 24 of the molded housing 10. The connector 2 will then be positioned with the wires 4 to be terminated resting on the inclined surfaces of the wire retention members 14. After the electrical connector 2 is positioned on the termination fixture 60, with wires 4 in alignment with wire receiving slots 32, the electrical connector or commoning block 2 will be pressed toward the termination fixture 60 with the housing walls entering the slots 66 and the terminals entering further into the slots 64. The wires 4 will then be pushed into the wire receiving slots 32 to terminate the wires 4. The wire retention members 14 will grip the wires 4, with the tangs 16 gripping the wire insulation, so that the electrical connector 2, with the wires 4 attached can be removed from the termination fixture 60. The electrical connector 2 then becomes part of the wiring or harness assembly, and the electrical connector 2 can be adhesively bonded to the substructure 50 in the manner discussed previously.

Figure 12:
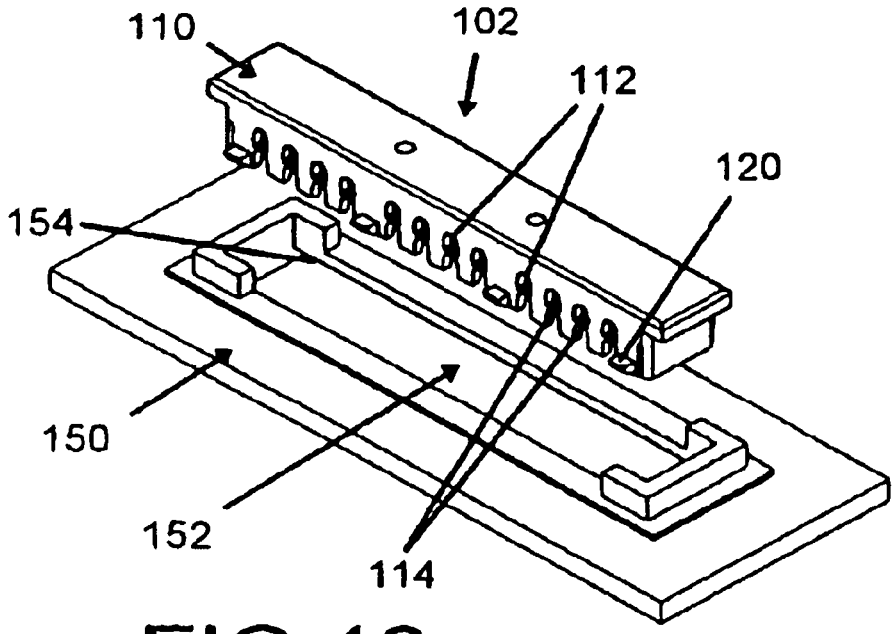
FIG. 12 is a view of an alternated embodiment of this invention that can snapped into a trench on a substructure, such as an automobile headliner.

Although adhesive bonding is an efficient method of securing the electrical connector 2 to the substructure, alternative means of mounting a terminated electrical connector are permissible. A second embodiment, shown in FIG. 12, shows a configuration in which the electrical connector 102 is snapped into a recess 152 on a substructure 150. The connector 102 includes conventional snap latches 120 along the sides of the housing 110. These latches 120 engage the bottom edges 154 of the trench or recess mounting recess 152, which serve as latching shoulders. The connector 102 also shows that other wire retention members can be used on some embodiments of this electrical connector. Wire retention barbs 114 are located within each channel 112. These barbs 114 will retain wires within wire receiving slots, but latching barbs 114 do introduce certain complications. Wire retention barbs 114 located within channels 112 increase the height of connector housing 110 compared to connector housing 10 or the previous embodiment. Barbs 114 either require side pulls when the connector housing 110 is molded or otherwise introduce complexity into the mold and the molded connector housing 110. Therefore, although a connector 102, with barbs 114, is suitable for certain aspects of this invention, it is believed that the wire retention members 14 are less expensive to mold.

Modifications other than those illustrated in FIG. 12 can be introduced into the preferred embodiment of FIGS. 1–8 by one of ordinary skill in the art. Some of these modifications may be incompatible with certain aspects of this invention, but may still be conform to other aspects of this invention. Therefore the invention is not defined by the representative embodiments depicted herein, but are set forth in the following claims.

We claim:

1. An electrical connector for use in commoning wires and for mounting the wires on a substructure, the electrical connector comprising:

a molded housing including a cavity formed by an interior surface of at least one wall with channels extending through the wall for insertion of the wires;

at least one insulation displacement terminal mounted in the cavity and secured to the molded housing, each insulation displacement terminal including multiple wire receiving slots aligned with the channels extending though the walls, each insulation displacement terminal comprising means for commoning at least two wires; and, wire retention members molded as part of the housing, and extending outwardly from an exterior surface of the wall on each side of each said channels the wire retention members having tangs aligned with the channels and inclined in an insertion direction of the wires to form a restricted opening between the tangs of adjacent ones of said wire retention members.

2. The electrical connector of claim 1 wherein each insulation displacement terminal comprises U-shaped member with the wire receiving slots extending into each of two parallel sidewalls extending upwardly from a terminal base, the terminal base being permanently secured to the molded housing.

3. The electrical connector of claim 1 wherein multiple insulation displacement terminals are positioned, end to end, within the same cavity.

4. The electrical connector of claim 3 wherein the cavity is formed in part by the interior surfaced of two opposed walls, each wall including aligned channels and aligned wire retention members to permit wire to pass through the electrical connector.

5. The electrical connector of claim 4 wherein a segmented ledge is formed in surrounding relationship to the cavity, the segmented ledge extending beyond the two walls and being formed by surfaces on end of the wire retention members opposite the tangs.

6. The electrical connector of claim 4 wherein each insulation displacement terminal is secured to a cavity base wall extending between the two opposed walls.

7. The electrical connector of claim 6 wherein two alignment holes extend through the base wall between insulation displacement terminals, the two alignment holes comprising means for receiving alignment pins on a wire termination fixture engagable with the electrical connector to insert wires into the wire receiving slots.

8. The electrical connector of claim 1 wherein the channels are open at a mounting edge of the wall and the wall includes mounting surfaces on the mounting edge flanking open ends of the channels, the mounting surfaces comprising means for mounting the electrical connector on the substructure.

9. The electrical connector of claim 8 wherein the mounting surfaces comprise flat surfaces comprising means for adhesively securing the electrical connector to the substructure.

10. The electrical connector of claim 1 wherein the wire retention members are located in nonoverlapping relationship relative to remaining portions of the molded housing, so that the housing can be molded with only straight action mold tooling.

11. The electrical connector of claim 10 wherein the wire retention members included support ribs, each support rib extending between two adjacent channels.

12. A low profile electrical connector for commoning wires and adapted for mounting on a substrate, the connector comprising:

a one-piece molded housing including:

a mounting surface for mounting the housing on a substrate, a cavity defined by an interior surface of at least one wall and a base with channels extending through the wall, the cavity extending into the mounting surface, and wire retention members molded as part of the housing, each entire wire retention member extending outwardly from an exterior surface of the wall on each side of each said channel, the wire retention members having tangs aligned with the channels and inclined in an insertion direction of the wires to form a restricted opening between the tangs of adjacent ones of said wire retention members; and at least one insulation displacement terminal mounted in the cavity and secured to the base of the cavity, each insulation displacement terminal including multiple wire receiving slots extending toward the mounting surface and aligned with the channels extending through the walls, each insulation displacement terminal comprising means for commoning at least two wires.

13. The electrical connector of claim 12 wherein the at least one insulation displacement terminal comprises two terminal walls extending upwardly from a terminal base the terminal base having mounting openings therein, the insulation displacement terminal being secured to the base of the cavity by tabs integral to the housing and extending through the mounting openings.

* * * * *